United States Patent [19]

Akasaka et al.

[11] Patent Number: 4,811,698

[45] Date of Patent: Mar. 14, 1989

[54] VALVE TIMING ADJUSTING MECHANISM FOR INTERNAL COMBUSTION ENGINE FOR ADJUSTING TIMING OF INTAKE VALVE AND/OR EXHAUST VALVE CORRESPONDING TO ENGINE OPERATING CONDITIONS

[75] Inventors: Akio Akasaka; Seiji Suga; Takanori Sawada, all of Kanagawa, Japan

[73] Assignee: Atsugi Motor Parts Company, Limited, Atsugi, Japan

[21] Appl. No.: 866,054

[22] Filed: May 21, 1986

[30] Foreign Application Priority Data

| | | | |
|---|---|---|---|
| May 22, 1985 | [JP] | Japan | 60-111115 |
| Jun. 6, 1985 | [JP] | Japan | 60-123371 |
| Jun. 28, 1985 | [JP] | Japan | 60-142996 |
| Jun. 28, 1985 | [JP] | Japan | 60-142997 |
| Apr. 24, 1986 | [JP] | Japan | 61-95335 |

[51] Int. Cl.[4] ..... F01L 1/34

[52] U.S. Cl. ..... 123/90.17; 123/90.31

[58] Field of Search ..... 123/90.17, 90.15, 90.18, 123/90.31; 64/24, 25; 74/568, 395; 464/2, 160

[56] References Cited

U.S. PATENT DOCUMENTS

| | | | |
|---|---|---|---|
| 2,159,017 | 5/1939 | Duncan | 123/90.15 |
| 2,162,243 | 6/1939 | Browne | 123/90.15 |
| 3,685,499 | 8/1972 | Meacham | 123/90.15 |
| 3,978,829 | 9/1976 | Takahashi | 123/90.17 |
| 4,231,330 | 11/1980 | Gargea | 123/90.15 |
| 4,463,712 | 8/1984 | Stojek | 123/90.17 |
| 4,498,431 | 2/1985 | Nakamura | 123/90.17 |
| 4,535,731 | 8/1985 | Banfi | 123/90.17 |
| 4,561,390 | 12/1985 | Nakamura et al. | 123/90.17 X |
| 4,708,101 | 11/1987 | Hara et al. | 123/90.17 X |

FOREIGN PATENT DOCUMENTS

| | | |
|---|---|---|
| 3247916 | 6/1984 | Fed. Rep. of Germany . |
| 0120707 | 7/1984 | Japan . |

*Primary Examiner*—Willis R. Wolfe, Jr.

*Attorney, Agent, or Firm*—Bachman & LaPointe

[57] ABSTRACT

A valve timing adjusting mechanism houses a timing adjusting gear assembly within a liquid-tight housing which prevents working fluid used to adjust the timing from coating a timing gear engaging a timing belt. The working fluid is introduced within the housing to exert timing adjusting force on the timing adjusting mechanism, resulting in relative angular displacement between a camshaft and the timing gear which is manifested as an adjustment to the valve timing. With this arrangment, the timing belt is free of working fluid. Therefore, the lifetime of the belt retains its design value and slip between the timing belt and the timing gear can be prevented.

10 Claims, 7 Drawing Sheets

VALVE TIMING ADJUSTING MECHANISM FOR INTERNAL COMBUSTION ENGINE FOR ADJUSTING TIMING OF INTAKE VALVE AND/OR EXHAUST VALVE CORRESPONDING TO ENGINE OPERATING CONDITIONS

BACKGROUND OF THE INVENTION

The present invention relates generally to a valve timing adjusting mechanism for an internal combustion engine, which adjusts the timing of intake valve and/or exhaust valve actuation in accordance with the engine operating conditions. More specifically, the invention relates to a valve timing adjusting mechanism which is applicable not only to chain-drive-type timing systems but also to belt-drive-type timing systems.

As is well known, adjusting the intake valve timing and/or exhaust valve timing depending upon engine operating conditions, such as engine speed, engine load and so forth, helps optimize engine operation. For the sake of realizing engine operating condition-dependent valve timing control, a Timing Variator For The Timing System of Reciprocating Internal Combustion Engine has been proposed in U.S. Pat. No. 4,231,330, issued to Garcea, on Nov. 4, 1980. The disclosed timing variator hydraulically controls the angular position of intake valve and/or exhaust valve driving camshaft relative to a timing gear driven by the engine in synchronism with engine revolution.

On the other hand, in recent years, there has been a trend in the market toward lighter internal combustion engines for better vehicle drivability and for better fuel economy. In order to answer this requirement, belt-drive-type timing systems which significantly reduce the weight of the engine have been developed and put on the market. These belt-drive timing systems are known to create less noise than conventional chain-drive timing systems.

The timing variator of the aforementioned United States Patent is not applicable to such belt-drive timing systems since the working fluid, specifically engine lubricant used to actuate the valve timing would affect the timing belt and/or engagement between the timing belt and the timing gear. Specifically, in the timing variator of the United States Patent, the working fluid would react with material components of the belt and shorten its lifetime. Moreover, the working fluid tends to cause the belt to slip and thus adversely affects timing control.

SUMMARY OF THE INVENTION

Therefore, it is a principle object of the present invention, to provide a timing adjusting mechanism which is applicable to belt-drive timing systems of internal combustion engines.

Another object of the invention is to provide a timing adjusting mechanism with backlash-free gear engagement in a timing system for driving a camshaft.

In order to accomplish the above-mentioned and other objects, a valve timing adjusting mechanism, according to the present invention, houses a timing adjusting gear assembly within a liquid-tight housing which prevents working fluid used to adjust the timing from coating a timing gear engaging a timing belt. The working fluid is introduced within the housing to exert timing adjusting force on the timing adjusting mechanism, resulting in relative angular displacement between a camshaft and the timing gear which is manifested as an adjustment to the valve timing.

With this arrangement, the timing belt is free of working fluid. Therefore, the lifetime of the belt retains its design value and slip between the timing belt and the timing gear can be prevented.

According to one aspect of the invention, a valve timing adjusting mechanism for an internal combustion engine comprises a camshaft carrying a cam for driving one of an intake valve and an exhaust valve, the camshaft having a section formed with first helical gear teeth, a cam pulley adapted to be driven by the engine for rotation in synchronism with engine revolution, the cam pulley having second helical gear teeth, a ring gear having inner and outer helical gear teeth engageable with the first and second gear teeth of the camshaft and the cam pulley, first means for defining an enclosed chamber facing one planar face of the ring gear and connected with a fluid pressure source to receive pressurized fluid therefrom, a spring means associated with the other planar face of the ring gear for exerting an initial biasing force on the ring gear in opposition to the force due to the pressure on the ring gear from the enclosed chamber,and second means for controlling the fluid pressure introduced into the enclosed chamber in accordance with engine operating conditions so as to shift the ring gear between a first initial position, in which the camshaft and the cam pulley are in a predetermined first angular relationship with each other in which they drive the one of an intake valve and an exhaust valve at first timing relative to engine revolution, and a second position, in which the camshaft and the cam pulley are angularly displaced relative to each other to a second angular relationship in which they drive the one of an intake valve and an exhaust valve at second timing relative to engine revolution.

With the construction of the valve timing adjusting mechanism according to the present invention, the working fluid may not flow to the outer periphery of the cam pulley. Therefore, in case of belt-drive type timing system, a timing belt driving the cam pulley will never be subjected to the working fluid, such as engine lubricating oil, and thus free from chemical reaction of the material of the working fluid with the material of the timing belt.

Preferable, the ring gear comprises a first ring component and a second ring component, both of which have inner and outer gear teeth, the first and second ring components being movable toward and away from each other to provide variable meshing cross-section of each of gear teeth for engaging with corresponding one of first and second helical gear teeth with no back-rash. The first and second ring components are axially movable to each other for adjusting the meshing cross-section of gear tooth. There is further provided a connection means connecting the first and second ring components to each other, the connection means being active for biasing at least one of the first and second ring components toward the other.

With the ring gear constructed as above, it is assured firm engagement between the meshing gears to provide accurate and steady driving of the camshaft relative to engine revolution through the cam pulley.

One of the first and second ring components may be provided with a section to engage with a tool for adjusting meshing cross-section.

In alternative embodiment, there is provided a connecting means for connecting the first and second ring components to each other, the connecting means being active for biasing at least one of the first and second ring components in a direction to move the on of first and second ring components away from the other.

According to another aspect of the invention, a valve timing adjusting mechanism for an internal combustion engine comprises a camshaft connected to an engine combustion chamber valve for actuating the valve when driven to rotate, a cam pulley, a timing belt coupling the cam pulley to the engine for corotation, the timing belt being susceptible to damage and/or malfunction when exposed to engine lubricant, means for coupling the cam pulley to the camshaft for corotation in an adjustable phase relationship, the coupling means being exposed to engine lubricant, and sealing means defining an enclosed chamber around the coupling means and connected to a source and a drain of engine lubricant, the sealing means forming a liquid-tight enclosure preventing leakage of lubricant from the chamber to the timing belt.

The camshaft and the cam pulley rotate about parallel axes and both have helical gear teeth of essential equal pitch, and the coupling means comprises a ring gear made up of two gear rings, each of which has helical gear teeth internally and externally engaging the gear teeth of the camshaft and the cam pulley respectively, the gear rings being biased away from each other axially toward a maximal axial separation, whereby the gear rings are urged into a backlash-free engagement with the camshaft and the cam pulley.

The valve timing adjusting mechanism further comprising a pressure source acting on the engine lubricant to pressurize same to an extent related in a known way to engine operating conditions and supplying the pressurized lubricant to the enclosed chamber, and wherein the ring gear is exposed to the enclosed chamber at one end so as to be urged axially in a first direction by the pressure of the lubricant and biased axially in the direction opposite the first direction by a spring, whereby the lubricant pressure determines the axial relationships among the camshaft, the ring gear and the cam pulley and thus determines the phase relationship between the camshaft and the cam pulley during corotation.

According to a further aspect of the invention, a valve timing adjusting mechanism for an internal combustion engine comprises a camshaft carrying a cam for driving one of an intake valve and an exhaust valve, the camshaft having a section formed with first helical gear teeth, a cam pulley adapted to be driven by the engine for rotation in synchronism with engine revolution, the cam pulley having first helical gear teeth, a ring gear having inner and outer helical gear teeth engageable with the first and second gear teeth of the camshaft and the cam pulley, which ring gear comprises a first ring component and a second ring component, both of which have inner and outer gear teeth, the first and second ring components being movable toward and away from each other to provide variable meshing cross-section of each of gear teeth for engaging with corresponding one of first and second helical gear teeth with no backlash, a spring means associated with the other planar face of the ring gear for exerting an initial biasing force on the ring gear in opposition to the force due to the pressure on the ring gear from the enclosed chamber, and first means for controlling the fluid pressure introduced into the enclosed chamber in accordance with engine operating conditions so as to shift the ring gear between a first initial position, in which the camshaft and the cam pulley are in a predetermined first angular relationship with each other in which they drive the one of an intake valve and an exhaust valve at first timing relative to engine revolution, and a second position, in which the camshaft and the cam pulley are angularly displaced relative to each other to a second angular relationship in which they drive the one of an intake valve and an exhaust valve at second timing relative to engine revolution.

The second means includes a seal for enclosing the chamber so as to prevent the pressurized fluid from leaking to outer periphery of the cam pulley.

BRIEF DESCRIPTION OF THE DRAWINGS

The present invention will be understood more fully from the detailed description given herebelow and from the accompanying drawings of the preferred embodiments of the invention, which, however, should not be taken to limit the invention to the specific embodiments, but are for explanation and understanding only.

In the drawings.

DESCRIPTION OF THE PREFERRED EMBODIMENT

Figure 1:
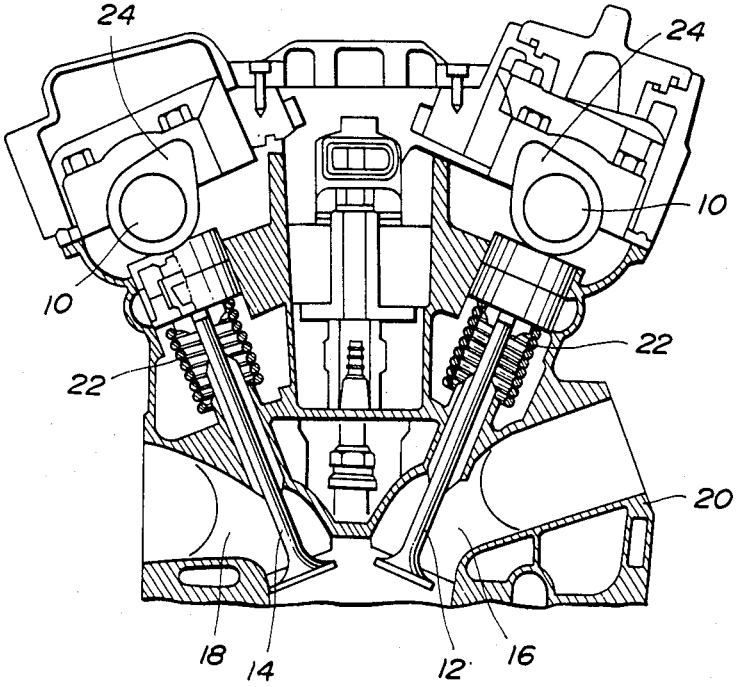
FIG. 1 is a sectional view of an example of an Otto-type reciprocating internal combustion engine to which the preferred embodiment of a valve timing adjusting mechanism according to the present invention is applicable.
Figure 2:
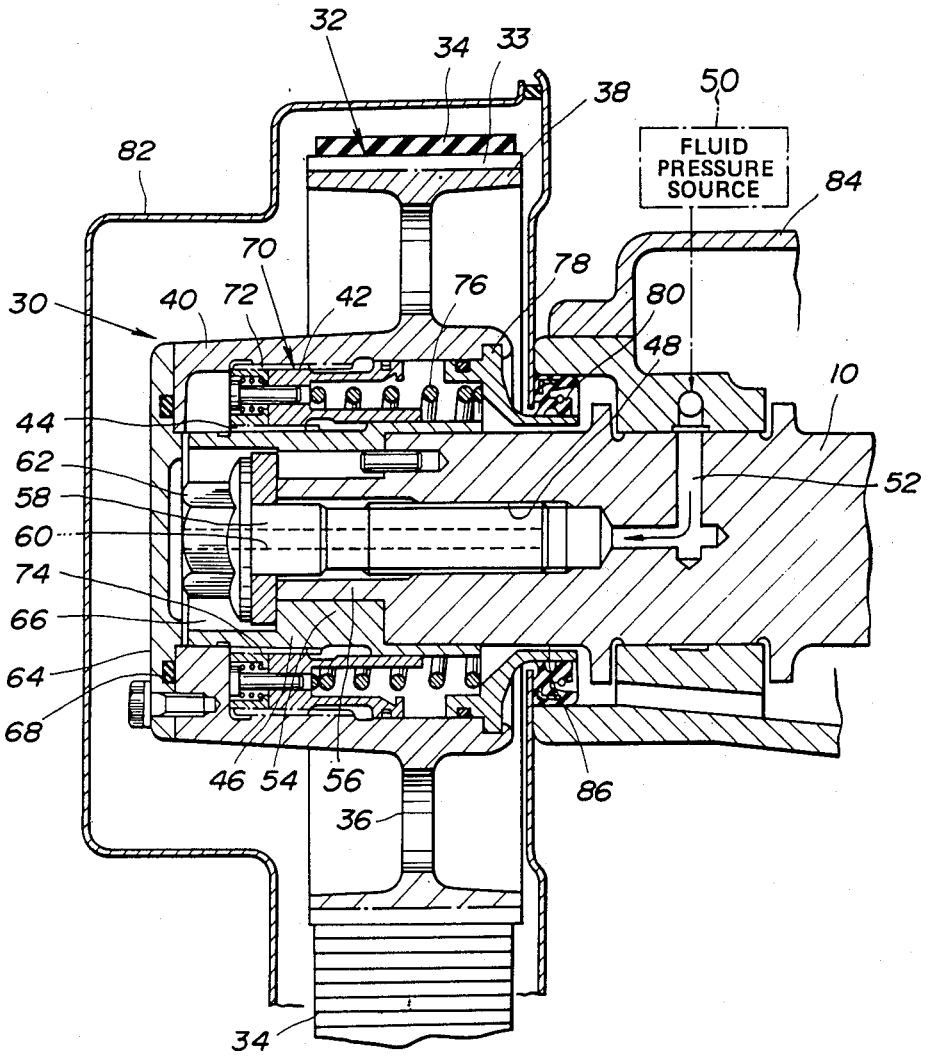
FIG. 2 is a sectional view of the preferred embodiment of the valve timing adjusting mechanism according to the present invention.

Referring now to the drawings, particularly to FIGS. 1 and 2, the preferred embodiment of a valve timing adjusting mechanism, according to the present inventoon, is especially designed for an Otto-type reciprocating internal combustion engine with over-head camshafts 10 for actuating intake valve or valves 12 and/or exhaust valve or valves 14. The shown embodiment is directed in particular to the valve timing adjusting mechanism for a double over-head camshaft-type internal combustion engine. However, application to double over-head camshaft internal combustion engines should not be understood as being an essential feature of the present invention.

As is well known, the camshaft 10 is designed to drive the intake valve 12 and/or exhaust valve 14 to open the induction port 16 and/or the exhaust port 18 of an engine block 20 against the spring force of valve springs 22. The camshaft 10 has a plurality of valve driving cams 24 designed to drive the corresponding intake valves 12 or exhaust valves 14 at a timing controlled in relation to engine revolution. The cam profiles are designed so that the open periods of corresponding intake and exhaust valves overlap suitably near the top dead center of a piston (not shown) in the corresponding engine cylinder 26.

Figure 3:
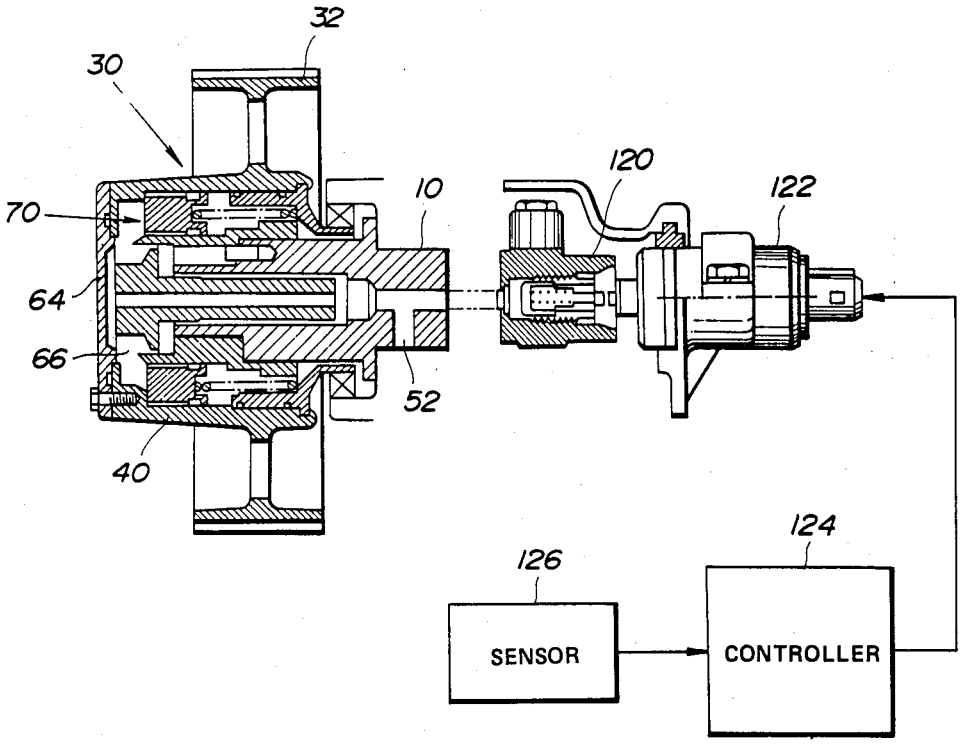
FIG. 3 is a diagrammatic illustration showing a control system for the preferred embodiment of a valve timing adjusting mechanism of FIG. 2.

As shown in FIGS. 2 and 3, the preferred embodiment of the valve timing adjusting mechanism 30 is associated with the camshaft 10 for controlling valve timing in relation to engine revolution. The valve timing adjusting mechanism 30 includes a cam pulley 32 which has a plurality of axial irregularities 33 about its outer periphery. The cam pulley 32 engages a timing belt 34 driven by the engine. The cam pulley has an integral web section 36 extending radially inwards from an outer cylindrical section 38, on which the irregularities 33 appear, to an inner hollow cylindrical section 40 integral with the web section 36. The inner cylindrical section 40 constitutes part of a housing for the rest of the valve timing adjusting mechanism 30.

Helical gear teeth 42 are formed on the inner periphery of the inner cylindrical section 40. The helical gear teeth 42 oppose helical gear teeth 44 on an essentially cylindrical sleeve 46 across a radial clearance. The sleeve 46 engages a stepped axial end of the camshaft 10. The camshaft 10 has an axial bore 48 at the stepped axial end. The outer end of the axial bore 48 is open and the inner end thereof is in communication with a pressure source 50 for the working fluid, e.g. engine lubricant, through a fluid path 52.

The sleeve 46 has one or more radially inward projections 54 on its inner periphery. The inner face of the projection 54 mates with the outer periphery of a smaller-diameter section 56 at the axial end of the camshaft 10. A mounting pin 58 is pressed into the axial bore 48 of the camshaft 10 so as to fix the sleeve 46 to the axial end of the camshaft. The mounting pin 58 has an axial opening 60 connected with the fluid path 52. The other end of the axially extending opening 60 opens in the head section 62 of the mounting pin 58.

A cover plate 64 is fixed to the axial end of the inner cylindrical section 40 of the cam pulley 30. This defines an enclosed pressure chamber 66 within the sleeve 46. Liquid-tight engagement between the cover plate 64 and the axial end of the inner cylindrical section 40 is established by means of a sealing ring 68 interposed therebetween. The pressure chamber 66 is in communication with the fluid pressure source 50 through the fluid path 52 and the axial opening 60 in the mounting pin 58.

It should be noted that the working fluid, i.e. the engine lubricating oil flowing through the fluid path 52 may also serve as a lubricant for a bearing section 53 of a cam cover 84 in per se well known manner.

A ring gear 70 is inserted between the inner periphery of the inner cylindrical section 40, on which the helical gear teeth 42 are formed, and the outer periphery of the sleeve 46, on which the helical gear teeth 44 are formed.

The ring gear 70 has helical gear teeth 72 and 74 on its outer and inner surfaces respectively. The outer helical gear teeth 72 engage the gear teeth 42 of the inner cylindrical section 40 and the inner helical gear teeth 74 engage the helical gear teeth 44 of the sleeve 46. Therefore, the rotation of the cam pulley 30 driven in synchronism with engine revolution is transmitted to the camshaft 10 through the ring gear 70 and the sleeve 46.

The ring gear 70 has an axial end face opposing the aforementioned pressure chamber 66 and so subjected to the fluid pressure therein. On the other hand, the ring gear 70 is axially biased by means of a coil spring 76 in a direction opposite to the direction in which the fluid pressure acts. The coil spring 76 seats on the ring gear 70 at one end and at the other end on a horn-shaped mounting bracket 78 which is secured to the inner periphery of the inner cylindrical section 40. A sealing member 80 supported to a cover 82 and the cam cover 84 is in elastic contact with the mounting bracket 78 and so establishing therebetween a liquid-tight seal.

The inner periphery of the mounting bracket 78 surrounds the camshaft 10 with a small annular clearance 86. The annular clearance 86 serves as a working fluid return passage for recirculating the working fluid leaking through the meshing helical gears between the inner periphery of the inner cylindrical section 40 and the ring gear 70 and between the ring gear 70 and the outer periphery of the sleeve 46.

Figure 4:
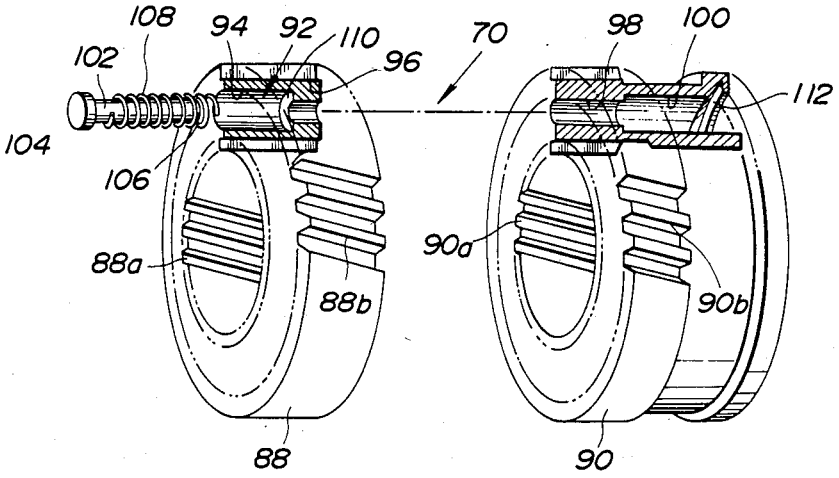
FIG. 4 is an exploded perspective view of a ring gear employed in the preferred embodiment of the valve timing adjusting mechanism of FIG. 2.
Figure 5:
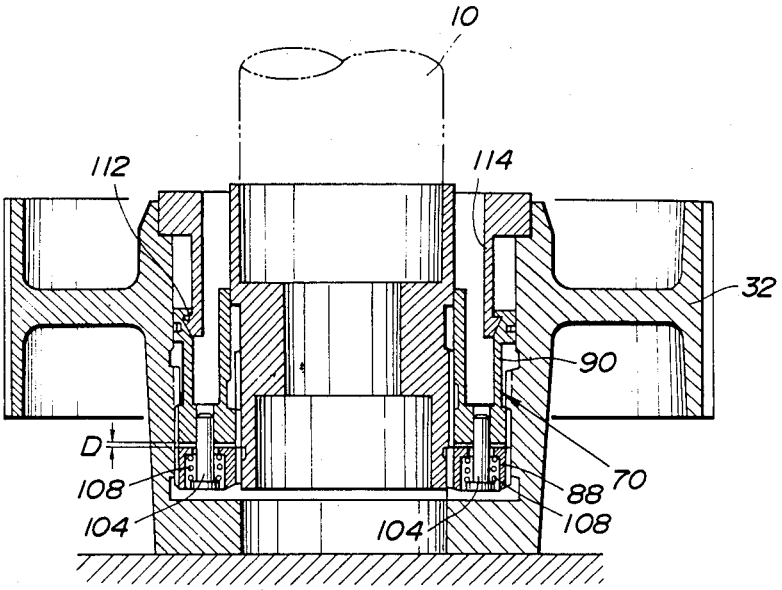
FIG. 5 is a sectional view of a ring gear interposed between a cam pulley and a camshaft.

As shown in FIGS. 4 and 5, the ring gear 70 comprises a first gear ring 88 and a second gear ring 90. The first gear ring has 88 inner and outer gear teeth **88*a* and 88*b*. The second gear ring 90 also has inner and outer gear teeth 90*a* and 90*b*. Each gear tooth of the inner and outer gear teeth 88*a* and 88*b* of the first gear ring 88 is arranged to form a single gear tooth 72 or 74 in conjunction with the corresponding one of gear teeth of the inner and outer gear teeth 90*a* and 90*b* of the second gear ring 90**, when the first and second gear rings are in their initial positions separated by an initial distance D.

In practice, the first and second gear rings 88 and 90 are integral to each other. After the gear teeth 72 and 74 are cut on the outer and inner surface an axial slice is remove to divide the first and second gear rings 88 and 90.

The first gear ring 88 is transpierced by a plurality of stepped bores 92, each made up of a larger-diameter section 94 and a smaller-diameter section 96. Smaller-diameter bores 98 in the second ring gear 90 are in alignment with the smaller-diameter sections 96. The ends of the smaller-diameter bores 98 remote from the first gear ring 88 communicate with larger-diameter bores 100 formed in the second gear ring 90. A plurality of pins 102 are inserted through the small-diameter sections 96 of the first ring gear 88 into the smaller-diameter bores 98 of the second gear ring 90, to which they are secured. The heads 104 of the pins 102 lie within the larger-diameter sections 94 of the bores 92 and seat one end of coil springs 108 wound around the stems 106 of the pins. The other end of the coil springs 108 seat on the radial step 110 between the larger diameter section 94 and the smaller diameter section 96 of the bores 92. Therefore, the coil springs 108 constantly bias the corresponding pins 102 away from the first gear ring 88. As a result, the first gear ring 88 is constantly urged toward the second gear ring 90 by the coil springs 108.

With the foregoing arrangement, the first gear ring 88 is axially movable toward and away from the second gear ring 90 so as to contract and expand the gap between the gear rings 88 and 90. Relative axial movement between the first and second gear rings 88 and 90, from the initial position offsets the gear teeth of the inner and outer gear teeth sets 88*a* and 88*b* of the first gear ring 88 from the corresponding gear teeth of the inner and outer gear teeth sets 90*a* and 90*b* of the second gear ring 90. As a result, the lateral width of the gear teeth 72 and 74, which are made up of the gear teeth 88*a*, 90*a* and 88*b*, 90*b*, expands with axial displacement of the first gear ring 88 relative to the second gear ring 90. Expansion of the gear tooth width results in firmer engagement between the inner gear 74 and the helical gear 44 of the sleeve 46 and between the outer gear 74 and the helical gear 42 of the inner cylindrical section 40 of the cam pulley 32.

The second gear ring 90 also has hooking jaws 112 which extend radially into the larger-diameter bores 100. The hooking jaws 112 are designed to engage hooks 114 of a machine tool during assembly.

Returning to FIG. 3, the fluid path 52 is also connected to a drain valve 120 which communicates with a drain passage (not shown) to recirculate the working fluid to the fluid pressure source. The drain valve 120 is connected to a control actuator 122 which actuates the valve between its closed and open positions. The control actuator 122 is electrically connected to a controller 124 to receive therefrom a control signal. The controller 124 is connected to various sensors 126 monitoring engine operating conditions, such as engine speed, air induction rate, engine coolant temperature, throttle valve angular position and so forth. The controller 124 derives the instantaneous engine operating conditions based on the engine operating parameters, such as engine speed, air flow rate, the engine coolant temperature, throttle valve angular position and so forth. The controller 124 derives the control signal to activate and deactivate the control actuator 122 in accordance with the derived engine operating conditions.

In practice, the preferred embodiment of the valve timing adjusting mechanism, according to the present invention, controls valve overlap by adjusting the valve timing of the intake valve 12 relative to the exhaust valve 14. The range of adjustment of the valve overlap may be expanded by adjusting the timing of not only the intake valve 12 but also the exhaust valve 14. The controller 124 derives the control signal from the engine operating parameters monitored by the sensors 126. In general, the valve overlap varies with engine speed. Specifically, valve overlap is greater at high engine speeds than that at low engine speed. Therefore, the controller 124 generally derives the control signal by comparing the engine speed monitored by one of the sensors 126 with an engine speed criterion which may be determined according to the desired engine performance.

When the engine speed is higher than or equal to the engine speed criterion, the controller 124 outputs a HIGH-level control signal to order the control actuator 122 to actuate the drain valve 120 to its closed position. As a result, the fluid pressure from the fluid pressure source 50 is introduced into the pressure chamber 66. When the fluid pressure built up in the pressure chamber 66 overcomes the biasing force exerted on the ring gear 70, the ring gear is shifted to the left in FIG. 2. During this rightward movement, the ring gear 70 is angularly displaced relative to the camshaft 10 due to the gear engagement between the helical gear teeth 44 and 74. Angular displacement of the ring gear 70 drives the cam pulley 32 angularly relative to the camshaft.

It should be noted that the action of the ring gear 70 and relative angular displacement between the camshaft 10 and cam pulley 32 in response to the ring gear action have been disclosed in the U.S. Pat. No. 4,231,330 to Gracea set forth above. The contents of U.S. Pat. No. 4,231,330 are hereby incorporated by reference for the sake of disclosure.

The direction of the angular displacement of the cam pulley 32 is to advance the intake valve open timing from its initial position. Advancing the intake valve open timing increases the valve overlap and so provides better engine performance in the high engine speed range.

On the other hand, when the engine speed drops below the engine speed criterion, the control signal from the controller 124 goes LOW. As a result, the control actuator 122 is deactivated to open the drain valve 120. As a result, the fluid pressure source 50 and the pressure chamber 66 both communicate with the drain passage. This causes a drop in the fluid pressure in the pressure chamber 66. Therefore, the spring force of the spring 76 overcomes the fluid pressure in the pressure chamber 66 and shifts the ring gear 70 back to the left in FIG. 2. This causes angular displacement of the ring gear 70 in the opposite direction to that due to rightward travel. Therefore, the cam pulley 2 is driven angularly relative to the camshaft 10 back toward the initial position. Returning the angular relationship between the cam pulley 2 and the camshaft 10 to its initial state retards the intake valve open timing to its initial timing and so reduces valve overlap relative to that used in the engine high speed range.

As is well known, in the low engine speed range, air/fuel mixture induction efficiency is optimized at a relatively small angle of valve overlap. Therefore, in the low engine speed range, better engine performance is obtained by reducing the valve overlap relative to that in the high speed range.

When assembling the ring gear 70 between the cam pulley 32 and the sleeve 46 fixed to the camshaft 10, first, the outer helical gear teeth 72 of the ring gear 70 is engaged with the helical gear teeth 42 of the inner cylindrical section 40 of the cam pulley 2. In order to adjust the engagement between the gear teeth 72 and 42 so as to reduce the gaps between the engaging gear teeth to zero for zero back-lash, the first gear ring 88 is shifted axially relative to the second gear ring 90 in order to expand the width of the gear teeth 72. After the outer helical gear teeth 72 fully engage the helical gear teeth 42, the assembly of the cam pulley 32 and the ring gear 70 is secured to the sleeve 46 by engaging the inner helical gear teeth 74 of the ring gear 70 with the helical gear teeth 44 of the sleeve.

Figure 6:
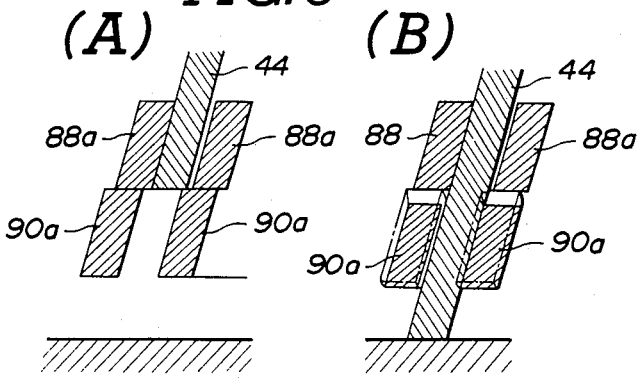
FIG. 6(*a*) and 6(*b*) are diagrams showing how the inner helical gear teeth of the ring gear engage the helical gear teeth of the camshaft.

At this time, since the first gear ring 88 is shifted relative to the second gear ring 90 for the gear mesh adjustment described above, the width of the gear teeth 74 is expanded. In this condition, each tooth of the gear teeth 44 tends to abut against the axial edge of the second gear ring 90, as shown in FIG. 6(*a*). This prevents the gear teeth 44 from engaging with the corresponding inner gear teeth 90*a* of the second gear ring 90. In order to enable each tooth of the gear teeth 44 of the sleeve to engage with the corresponding tooth 90*a* of the second gear ring 90, a tool with a hook 114 is used to pull the second gear ring 90 away from the first gear ring 88. This temporarily reduces the width of the gear teeth 74 to allow the gear teeth 44 to enter into engagement with the corresponding gear teeth 90*a*.

After the assembly of the cam pulley 2 and the ring gear 70 is attached to the sleeve 46 of the camshaft 10, the tool is removed.

Figure 7:
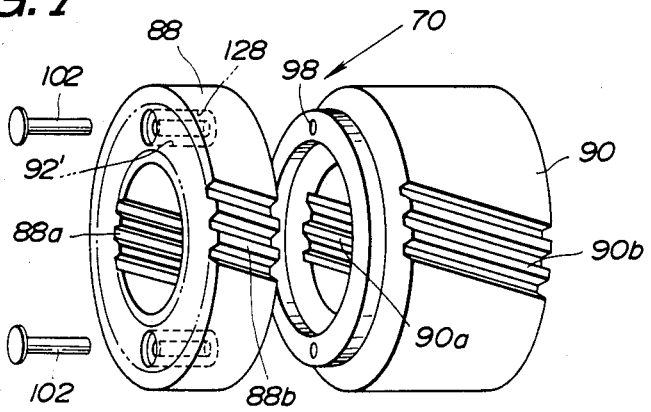
FIG. 7 is an exploded perspective view of a modification to the ring gear employediin the preferred embodiment of the valve timing adjusting mechanism according to the present invention.
Figure 8:
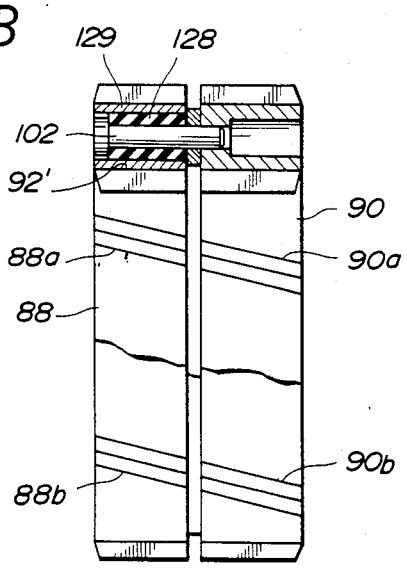
FIG. 8 is a sectional view through the assembled ring gear of FIG. 7.

FIGS. 7 and 8 show a modification to the ring gear 70. In this embodiment, the coil springs 108 in the foregoing preferred embodiment are replaced by a rubber bushing 128. The rubber bushing 128 is pre-assembled with a sleeve 129 which is fits firmly in the inner periphery of a bore 92' of constant diameter. The elastic force of the rubber bushing 128 serves to pull the first gear ring 88 toward the second gear ring 90, and thus has substantially the same effect as the coil spring 106 in the foregoing preferred embodiment.

Figure 9:
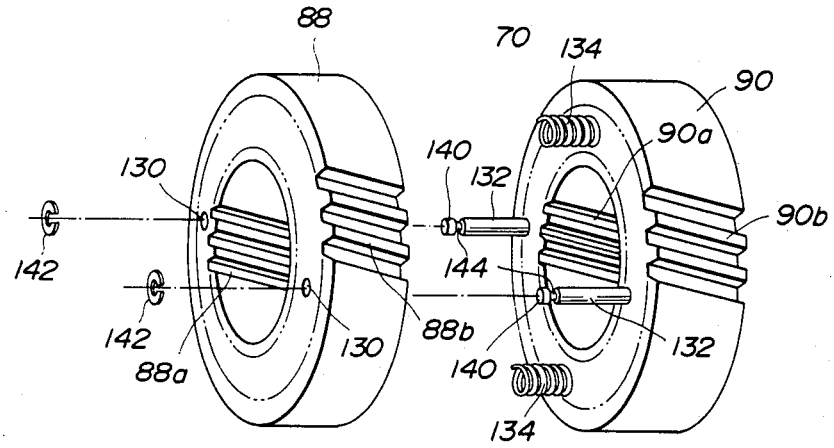
FIG. 9 is an exploded perspective view of another modification to the ring gear.
Figure 10:
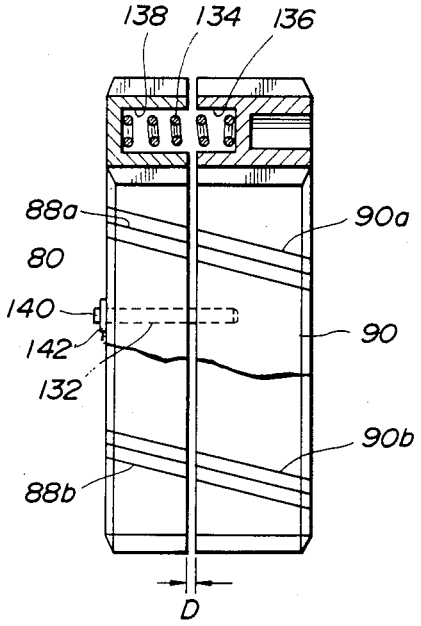
FIG. 10 is a sectional view through the assembled ring gear of FIG. 9.

FIGS. 9 and 10 show another modification to the gear ring 70 in the foregoing embodiment. In this embodiment, the spring force exerted on the first and second gear rings 88 and 90 urges them apart.

The first gear ring 88 has a pair of through openings 130 at diametrically opposed points. The axial face of the second gear 90 opposing the first gear ring 88 is provided with a pair of projecting pins 132 and a pair of coil springs 134. The projecting pins 132 are located at diametrically opposed points. The coil springs 134 are seated within rests 136 recessed into the opposing face of the second gear ring 90. The other ends of the coil springs 134 are seated within rests 138 formed in the opposing face of the first gear ring 88.

The projecting pins 132 extend through the openings 130 so that their heads 140 project from the distal face of the first gear ring 88. Snap rings 142 are fixed to neck sections 144 of the projectigg pins 132 to prevent retraction of the pins 132.

With this arrangement, the first gear ring 88 is constantly biased away from the second gear ring 90 by means of the coil springs 134. The movement of the first gear ring 88 away from the second gear ring 90 is limited by the snap rings 142 on the neck sections 144 of the projecting pins. Within the limited distance D, the first gear ring 88 is axially movable toward and away from the second gear ring 90 to offset the gear teeth **88*a* and 88*b* from the corresponding gear teeth 90*a* and 90*b* of the second gear ring 90. Offsetting the gear teeth 88*a* and 88*b* of the first gear ring 88 from the gear teeth 90*a* and 90*b* of the second gear ring 90 increases the width of each gear tooth of the inner and outer gears 74 and 72, which are respectively constituted by the gear teeth 88*a*, 90*a* and 88*b*, 90*b*. This ensures firm engagement between the inner gear 74 and the helical gear teeth 44 of the sleeve 46 and between the outer gear 72 and the helical gear teeth 42 of the inner cylindrical section 40 of the cam pulley 32**.

Figure 11:
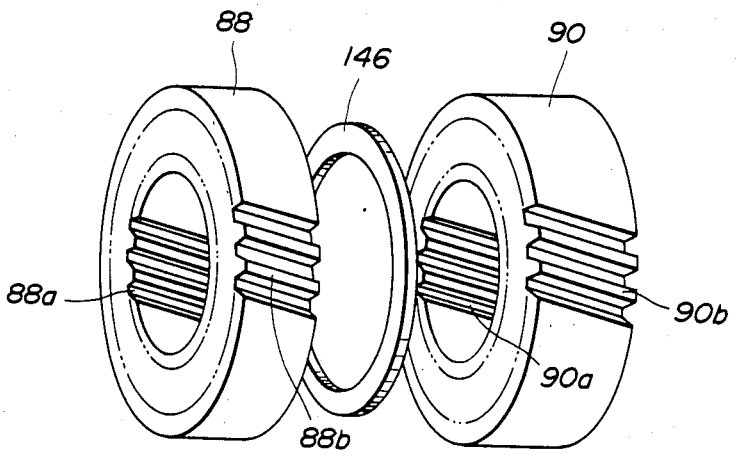
FIG. 11 is an exploded perspective view of a further modification to the ring gear.
Figure 12:
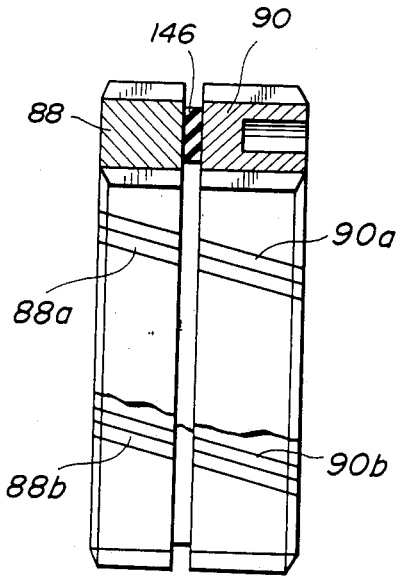
FIG. 12 is a sectional view through the assembled ring gear of FIG. 11.

FIGS. 11 and 12 show a further modification to the gear ring in the foregoing preferred embodiment. In this embodiment, an elastic ring 146 is employed as a replacement for the coil springs 134 of the embodiment of FIGS. 9 and 10. The effect of the elastic ring 146 is substantially the same as that of the coils springs 134.

As will be appreciated herefrom, according to the present invention, the valve timing adjusting mechanism can be applied to belt-drive timing systems for camshafts since the timing belt is not exposed to the working fluid. In addition, the gear rings help reduce back-lash for smooth transmission of the driving force to the camshaft.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A valve timing adjusting mechanism for an internal combustion engine comprising:

a camshaft carrying a cam for driving one of an intake valve and an exhaust valve, said camshaft having a section formed with first helical gear teeth;

a cam pulley engaging a timing belt driven by the engine for rotation in synchronism with engine revolution, said cam pulley having second helical gear teeth;

a ring gear having inner and outer helical gear teeth engageable with said first and second gear teeth of said camshaft and said cam pulley;

first means for defining an enclosed chamber facing one planar face of said ring gear and connected with a fluid pressure source to receive pressurized fluid therefrom;

a spring means associated with the other planar face of said ring gear for exerting an initial biasing force on said ring gear in opposition to the force due to the pressure on said ring gear from said enclosed chamber; and second means for controlling the fluid pressure introduced into said enclosed chamber in accordance with engine operating conditions so as to shift said ring gear between a first initial position, in which said camshaft and said cam pulley are in a predetermined first angular relationship with each other in which they drive said one of an intake valve and an exhaust valve at first timing relative to engine revolution, and a second position, in which said camshaft and said cam pulley are angularly displaced relative to each other to a second angular relationship in which they drive said one of an intake valve and an exhaust valve at second timing relative to engine revolution.

2. A valve timing adjusting mechanism for an internal combustion engine comprising:

a camshaft connected to an engine combustion chamber valve for actuating said valve when driven to rotate;

a cam pulley;

a timing belt coupling said cam pulley to the engine for corotation, said timing belt being susceptible to damage and/or malfunction when exposed to engine lubricant;

means for coupling said cam pulley to said camshaft for corotation in an adjustable phase relationship, said coupling means being exposed to engine lubricant; and sealing means defining an enclosed chamber around said coupling means and connected to a source and a drain of engine lubricant, said sealing means forming as liquid-tight enclosure preventing leakage of lubricant from said chamber to said timing belt.

3. A valve timing adjusting mechanism for an internal combustion engine comprising:

a camshaft connected to an engine combustion chamber valve for actuating said valve when driven to rotate ;

a cam pulley, said cam pulley rotating with said camshaft about parallel axes and both have helical gear teeth of essentially equal pitch;

a timing belt coupling said cam pulley to the engine for corotation, said timing belt being susceptible to demand and/or malfunction when exposed to engine lubricant;

means for coupling said cam pulley to said camshaft for corotation in an adjustable phase relationship, said coupling means being exposed to engine lubricant, said coupling means comprising a ring gear made up of two gear rings, each of which has helical gear teeth internally and externally engaging the gear teeth of said camshaft and said cam pulley respectively, said gear rings being biased away from each other axially toward a maximum axial separation to urge into a backlash-free engagement with said camshaft and said cam pulley; and sealing means defining an enclosed chamber around said coupling means and connected to a source and a drain of engine lubricant, said sealing means forming a liquid-tight enclosure preventing leakage of lubricant from said chamber to said timing belt.

4. The valve timing adjusting mechanism as set forth in claim 3, further comprising a pressure source acting on the engine lubricant to pressurize same to an extent related in a known way to engine operating conditions and supplying the pressurized lubricant to the enclosed chamber, and wherein said ring gear is exposed to said enclosed chamber at one end so as to be urged axially in a first direction by the pressure of the lubricant and biased axially in the direction opposite said first direction by a spring, whereby the lubricant pressure determines the axial relationships among said camshaft, said ring gear and said cam pulley and thus determines the phase relationship between said camshaft and said cam pulley during corotation.

5. A valve timing adjusting mechanism for an internal combustion engine comprising:

a camshaft carrying a cam for driving one of an intake valve and an exhaust valve, said camshaft having a section formed with first helical gear teeth;

a cam pulley adapted to be driven by the engine for rotation in synchronism with engine revolution, said cam pulley having second helical gear teeth;

a ring gear having inner and outer helical gear teeth engageable with said first and second gear teeth of said camshaft and said cam pulley, said ring gear comprising a first ring component and a second ring component, both of which have inner and outer gear teeth, said first and second ring components being movable toward and away from each other to provide variable meshing cross-section of each other of gear teeth for engaging with corresponding one of first and second helical gear teeth with no backlash;

first means for defining an enclosed chamber facing one planar face of said ring gear and connected with a fluid pressure source to receive pressurized fluid therefrom;

a spring means associated with the other planar face of said ring gear for exerting an initial biasing force due to the pressure on said ring gear in opposition to the force due to the pressure on said ring gear from said enclosed chamber; and second means for controlling the fluid pressure introduced into said enclosed chamber in accordance with engine operating conditions so as to shift said ring gear between a first initial position, in which said camshaft and said cam pulley are in a predetermined first angular relationship with each other in which they drive said one of an intake valve and an exhaust valve at first timing relative to engine revolution, and a second position, in which said camshaft and said cam pulley are angularly displaced relative to each other to a second angular relationship in which they drive said one of an intake valve and said exhaust valve at second timing relative to engine revolution.

6. A valve timing adjusting mechanism as set forth in claim 5, wherein said second means includes a seal for enclosing said chamber so as to prevent the pressurized fluid from leaking to outer periphery of said cam pulley.

7. A valve timing adjusting mechanism as set forth in claim 5, wherein said first and second ring components are axially movable to each other for adjusting said meshing cross section of gear tooth.

8. A valve timing adjusting mechanism as set forth in claim 7, which further comprises a connecting means for connecting said first and second ring components to each other, said connecting means being active for biasing at least one of said first and second ring components in a direction to move said one of first and second ring components away from the other.

9. A valve timing adjusting mechanism as set forth in claim 7, which further comprises a connecting means for connecting said first and second ring components to each other, said connecting means being active for biasing at least one of said first and second ring components toward the other.

10. A valve timing adjusting mechanism as set forth in claim 9, wherein one of said first and second ring components has a section to engage with a tool for adjusting meshing cross-section.

* * * * *